US006033259A

United States Patent [19]

Daoud

[11] Patent Number: 6,033,259

[45] Date of Patent: Mar. 7, 2000

[54] MOUNTING ARRANGEMENT FOR TELECOMMUNICATIONS EQUIPMENT

[75] Inventor: Bassel H. Daoud, Parsippany, N.J.

[73] Assignee: Lucent Technologies Inc., Murray Hill, N.J.

[21] Appl. No.: 09/111,089

[22] Filed: Jul. 6, 1998

[51] Int. Cl.[7] ..... H01R 13/73

[52] U.S. Cl. ..... 439/573; 439/540.1

[58] Field of Search ..... 439/573, 709–710, 439/715–16, 922, 404, 49, 532, 540.1; 174/79, 72, 72 B

[56] References Cited

U.S. PATENT DOCUMENTS 5,145,380 9/1992 Holcomb et al. ..... 439/49
5,632,647 5/1997 Dobbin et al. ..... 439/521
5,718,593 2/1998 Figueiredo et al. ..... 439/67.1
5,816,854 10/1998 Baggett et al. ..... 439/540.1

*Primary Examiner*—Lincoln Donovan

[57] ABSTRACT

An enclosure for telecommunications equipment (such as a building entrance protector) houses an assembly for terminating wires, such as twisted pairs, broken out from a multi-wire cable. The assembly is made by mounting two splicing connectors back-to-back with a specially designed bracket (e.g., a two-piece bracket). The assembly is mounted within the base of the enclosure. After terminating one or more wires at splicing contacts on one side of the assembly, the assembly can be removed from the base, rotated, and remounted within the base to expose splicing contacts on another side of the assembly in order to terminate additional wires from the cable. The present invention provides an efficient scheme for mounting splicing connectors within the limited volume provided within a building entrance protector.

16 Claims, 4 Drawing Sheets

100

MOUNTING ARRANGEMENT FOR TELECOMMUNICATIONS EQUIPMENT

BACKGROUND OF THE INVENTION

1. Field of the Invention

The present invention relates to telecommunications equipment and, in particular, to enclosures for housing and protecting telecommunications equipment.

2. Description of the Related Art

A building entrance protector (BEP) is an enclosure used to house and protect telecommunications equipment. For example, a BEP may house the components used to interface between a multi-wire cable providing telephone service to a building and the twisted pairs of copper wire for individual telephones distributed throughout the building. These interface components may include splicing connectors used to break out pairs of wires from a multi-wire cable, as well as electrical isolation interface components, such as protector panels used to receive high-voltage/high-current plug-in protectors, and connectors, such as insulation displacement connectors (IDCs), used to terminate twisted pairs from individual telephones. The BEP may have two or more hinged pieces that define one or more different compartments within the BEP for such functions as breaking out twisted pairs of wires from the multi-wire cable, connecting the twisted pairs to electrical isolation components, connecting the electrical isolation components to IDC connectors, and terminating the twisted pairs at the IDC connectors.

A splicing connector is designed to terminate a certain maximum number of twisted pairs from a cable. Similarly, a protector panel is designed to receive a certain maximum number of plug-in protectors, each of which corresponds to a single twisted pair. An efficient design for a building entrance protector will accommodate splicing connectors and protector panels that handle the same maximum number of twisted pairs. In addition, the larger the maximum number of twisted pairs that can be handled, the greater the variety of applications for which the BEP can be used.

SUMMARY OF THE INVENTION

The present invention is directed to a mounting arrangement for splicing connectors that enables a building entrance protector to be configured with splicing connectors and protector panels that handle the same relative large maximum number of twisted pairs, thereby providing a building entrance protector that can be used for a wide range of applications.

In one embodiment, the present invention is an enclosure for telecommunications equipment, comprising a base and an assembly mounted within the base. The assembly comprises two splicing connectors mounted back-to-back with a bracket, wherein, after terminating one or more wires at splicing contacts on one side of the assembly, the assembly can be removed from the base, rotated, and remounted within the base to expose splicing contacts on another side of the assembly for terminating additional wires.

In another embodiment, the present invention is a bracket for an enclosure for telecommunications equipment having a base. The bracket is adapted to mount two splicing connectors back-to-back to form an assembly adapted to be mounted within the base, wherein, after terminating one or more wires at splicing contacts on one side of the assembly, the assembly can be removed from the base, rotated, and remounted within the base to expose splicing contacts on another side of the assembly for terminating additional wires.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1A:
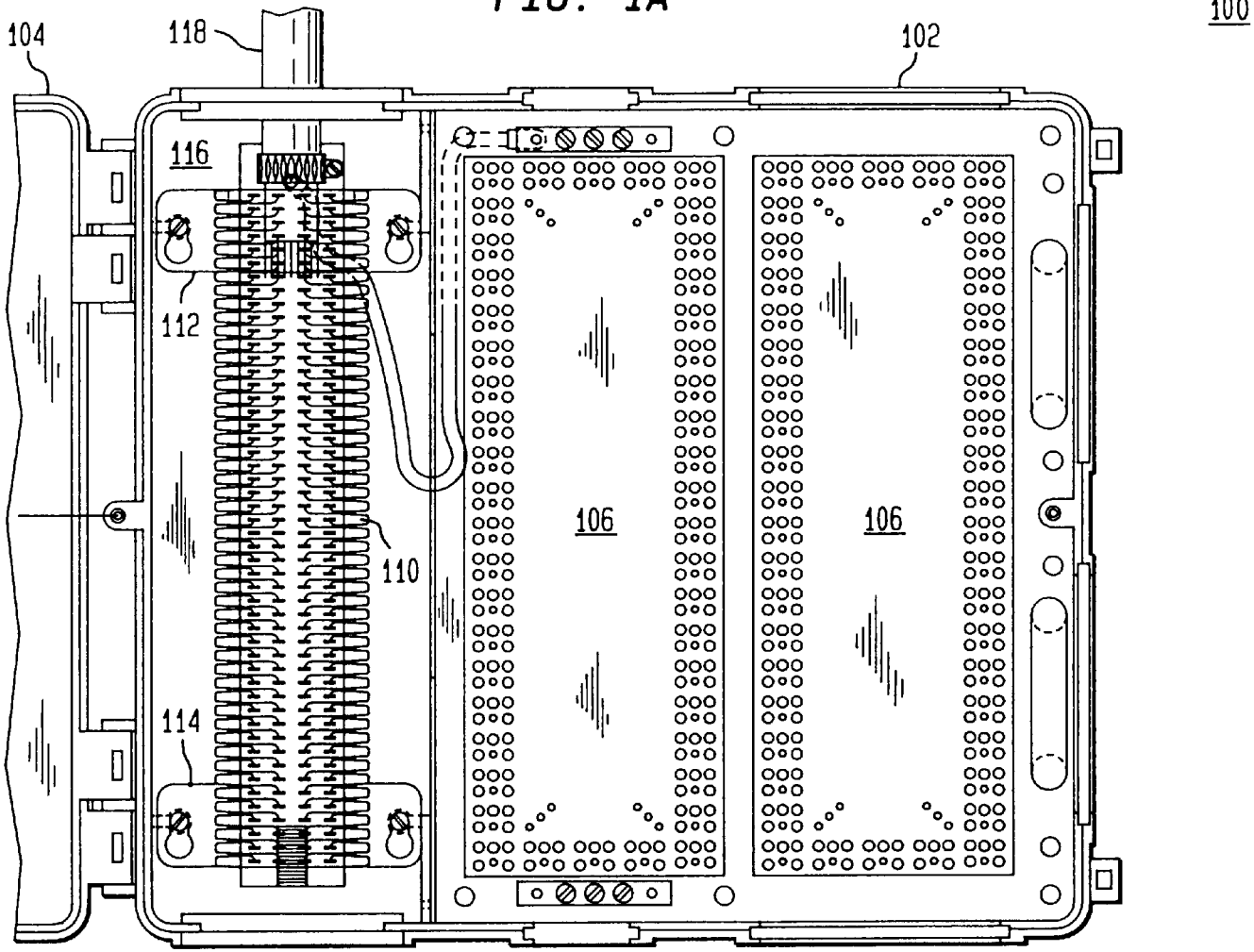
FIGS. 1A–C show front, cross-sectional end, and cross-sectional side views, respectively, of a building entrance protector, according to one embodiment of the present invention.
Figure 1C:
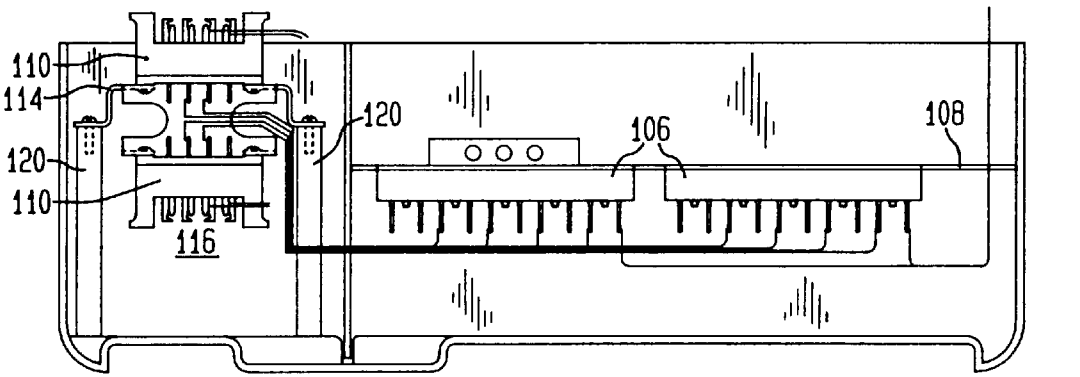
Figure 1B:
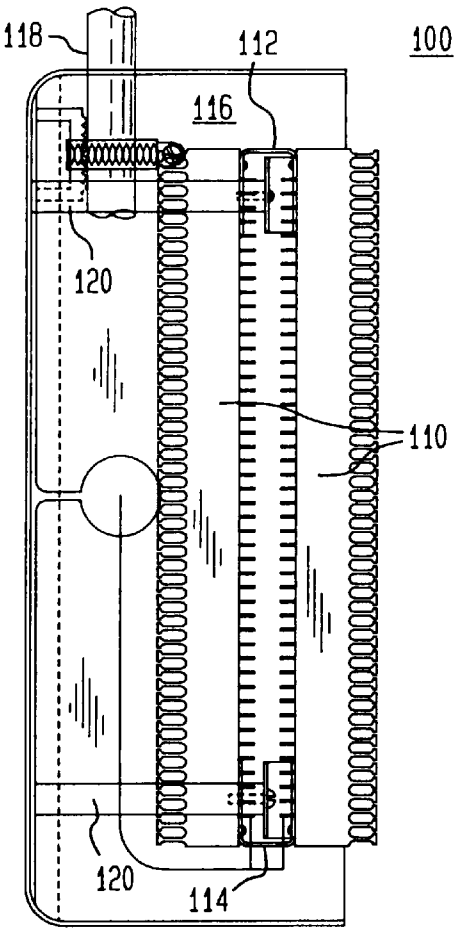

FIGS. 1(A)–(C) show front, cross-sectional end, and cross-sectional side views, respectively, of a building entrance protector 100 mounted with an arrangement of telecommunications equipment, according to one embodiment of the present invention. BEP 100 has a base 102 and a lid 104 (partially shown in FIG. 1(A)) pivotally connected to base 102. Base 102 has two 100-pair protector panels 106 mounted on mounting plane 108 of base 102 for receiving up to 200 plug-in protectors. In addition, base 102 has two 100-pair splicing connectors 110 for terminating up to 200 twisted pairs broken out from a cable 118, where the two splicing connectors 110 are mounted back-to-back using mounting brackets 112 and 114 in a splice chamber 116. In one implementation, the splicing connectors are 66-type D)C connector blocks.

Figure 2A:
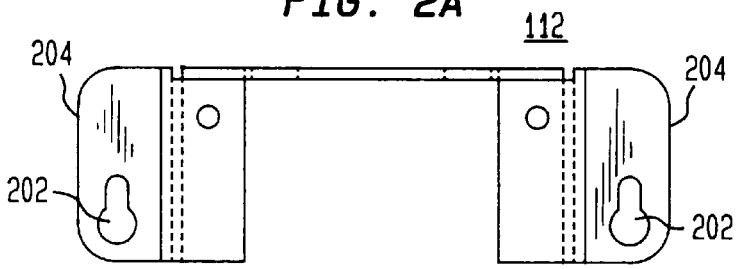
FIGS. 2(A)–(F) show views of the top and bottom mounting brackets of the BEP of FIGS. 1(A)–(C)
Figure 2B:
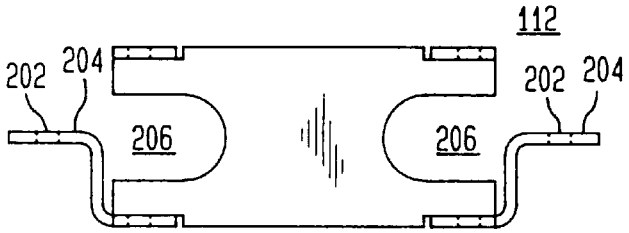
Figure 2C:
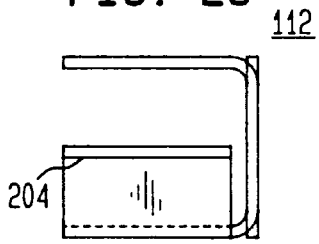
Figure 2D:
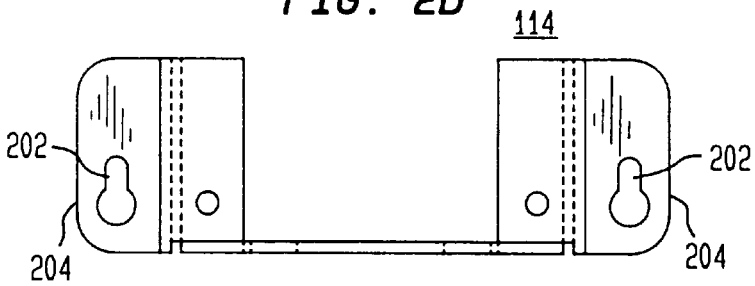
Figure 2E:
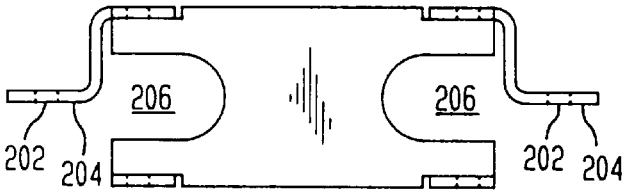
Figure 2F:
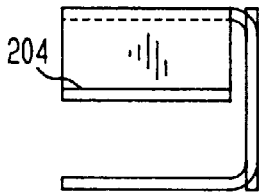

FIGS. 2(A)–(C) show top, side, and end views of top mounting bracket 112 of BEP 100. Similarly, FIGS. 2(D)–(F) show top, side, and end views of bottom mounting bracket 114 of BEP 100. Each bracket has a key hole 202 punched in a mounting flange 204 on each side. As shown in the side views of FIGS. 2(B) and 2(E), the center of each bracket also has two slotted circular punches 206 for passing and trapping fuse link wires from the splicing connectors 110.

Figure 3:
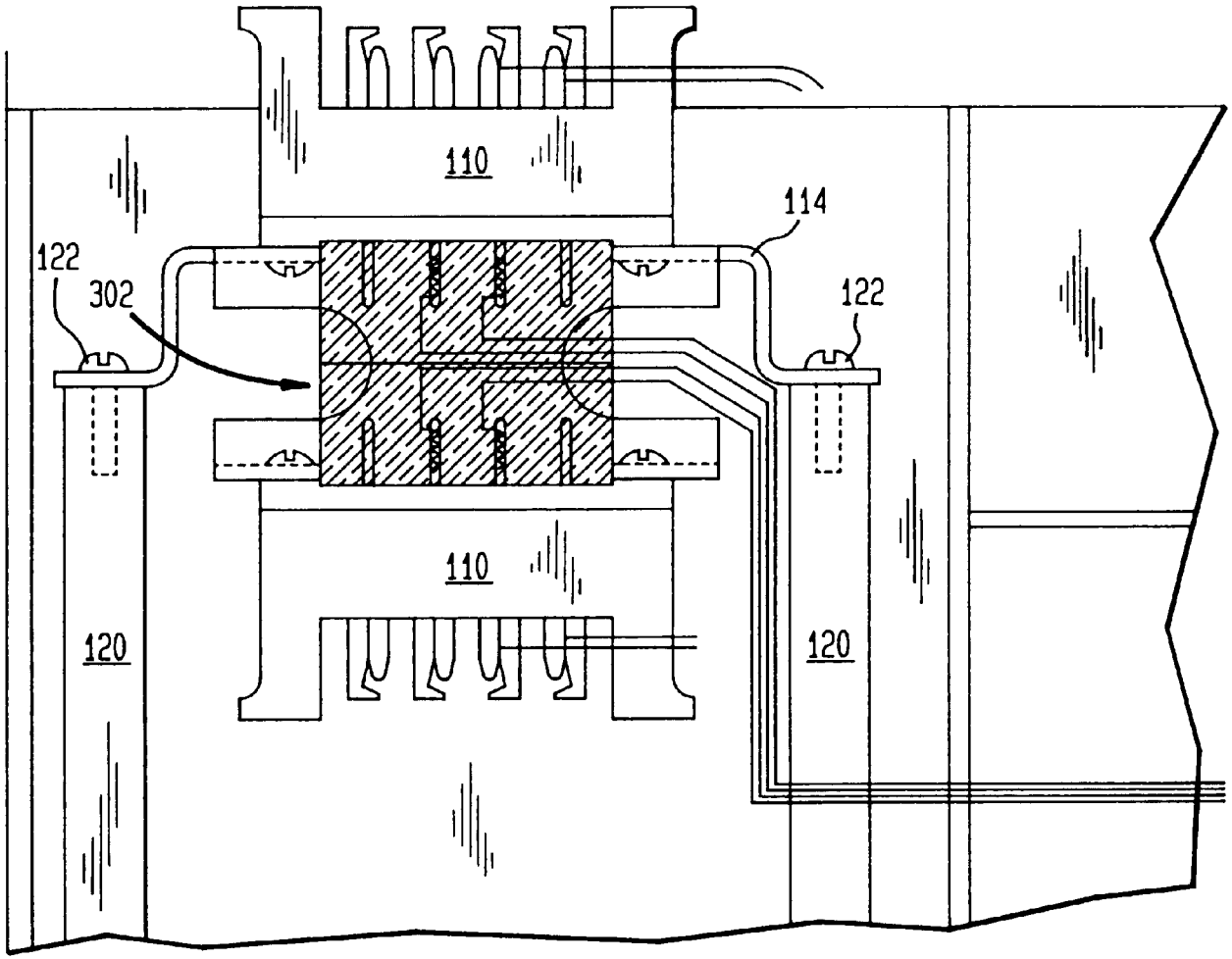
FIG. 3 is a detail of FIG. 1(B) showing a side view of the two splicing connectors and the bottom mounting bracket.

FIG. 3 is a detail of FIG. 1(B) showing a side view of the two splicing connectors 110 and bottom mounting bracket 114.

When the two splicing connectors 110 are mounted to the two mounting brackets 112 and 114, they form a single assembly, which can then be mounted via key holes 202 to four bosses 120 in cable chamber 116 of BEP 100 using screws 122. The use of key holes allows the splicing-connector/mounting-bracket assembly to be mounted and, if needed, removed from bosses 120 without having to completely remove screws 122 from the bosses.

In a typical application, BEP 100 is pre-wired in the factory such that, when BEP 100 is installed in a building, the wire-wrap contacts on the two 100-pair splicing connectors 110 are already wired to corresponding wire-wrap contacts on the two 100-pair protector panels 106. As shown in FIG. 3, when the two pre-wired splicing connectors 110 are mounted onto the mounting brackets 112 and 114 in the factory, a piece of foam insulation 302 may be compressed between the back faces of the splicing connectors. This foam insulation helps maintain the integrity of the wire-wrap connections by preventing the wires from slipping off the wire-wrap contacts.

When BEP 100 is installed in a building, when twisted pairs may be broken out from a multiwire cable, such as cable 118 of FIG. 1(A), and terminated at the IDC contacts of splicing connectors 110. In a preferred procedure, twisted pairs are terminated at the exposed IDC contacts on one side of the mounted splicing-connector/mounting-bracket assembly. When that side is filled with terminated pairs, screws 122 can be loosened, the splicing-connector/mounting-bracket assembly can be removed from bosses 120 by sliding the assembly to allow the heads of screws 122 to pass through the large ends of key holes 202, rotated 180 degrees to expose the IDC contacts on the other side of the assembly, and then remounted onto bosses 120 passing the heads of screws 122 through the large ends of key holes 202. The newly exposed IDC contacts can then be used to terminate additional twisted pairs from the multi-wire cable.

Thus, the present invention provides an efficient scheme for mounting splicing connectors and protector panels that handle a relatively large number of twisted pairs, into the finite volume provided within a building entrance protector.

Although the bracket arrangement shown in FIGS. 1(A)–(C) and 2(A)–(F) has two separate bracket pieces 112 and 114, alternative implementations of the present invention may utilize a single-piece bracket.

Although the present invention has been described in the context of a building entrance protector having a base and a lid that define a single level of interior chambers, those skilled in the art will understand that the BEP may have intermediate levels that may define, with the lid and the base, two or more different levels of interior chambers. Moreover, although only one multi-wire cable has been shown in the figures, it will be understood that two or more cables can be terminated within the same splicing chamber.

Similarly, although the invention has been described in the context of building entrance protectors, those skilled in the art will understand that the present invention can be applied to other types of enclosures for telecommunications equipment in which relatively large numbers of wires are to be terminated at connectors, such as 66-type IDC connector blocks.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. An enclosure for telecommunications equipment, comprising a base and a connector assembly mounted within the base, the connector assembly comprising first and second connector blocks mounted back-to-back with a bracket assembly, wherein:

each of the first and second connector blocks comprises one or more wire connectors on a first side of the connector block and one or more corresponding wire connectors on a second side of the connector block, wherein each wire connector on the first side is electrically connected to a corresponding wire connector on the second side; and after terminating one or more wires at one or more wire connectors of the first connector block on one side of the connector assembly, the connector assembly can be removed from the base, rotated, and remounted within the base without disconnecting any of the one or more wires, to expose one or more wire connectors of the second connector block on another side of the connector assembly in order to terminate one or more additional wires at one or more wire connectors of the second connector block.

2. The invention of claim 1, wherein the bracket assembly comprises a top bracket and a bottom bracket.

3. The invention of claim 1, wherein the bracket assembly has a plurality of key holes that allow the connector assembly to be removed from the base without having to remove screws that hold the connector assembly onto the base.

4. The invention of claim 3, wherein the base comprises a plurality of bosses for receiving the screws, upon which the connector assembly is mounted.

5. The invention of claim 1, wherein the connector assembly further comprises a piece of foam insulation mounted between the first and second connector blocks to inhibit wires from slipping off wire-wrap contacts on the first and second connector blocks.

6. The invention of claim 1, wherein the first and second connector blocks are 66-type IDC connector blocks.

7. The invention of claim 1, wherein the connector assembly is mounted within a splicing chamber of the enclosure used to terminate wires from a multi-wire cable received within the enclosure.

8. The invention of claim 1, wherein the enclosure further comprises one or more protector panels adapted to receive plug-in protectors and the connector assembly is wired to the protector panels.

9. The invention of claim 1, wherein the connector assembly is adapted to handle up to 200 twisted pairs.

10. The invention of claim 1, wherein the bracket assembly comprises a top bracket and a bottom bracket;

the top and bottom brackets each have two key holes that allow the connector assembly to be removed from the base without having to remove screws that hold the connector assembly onto the base;

the base comprises a plurality of bosses for receiving the screws, upon which the connector assembly is mounted;

the connector assembly further comprises a piece of foam insulation mounted between the first and second connector blocks to inhibit wires from slipping off wire-wrap contacts on the first and second connector blocks;

the first and second connector blocks are 66-type IDC connector blocks;

the connector assembly is mounted within a splicing chamber of the enclosure used to terminate wires from a multi-wire cable received within the enclosure;

the enclosure further comprises one or more protector panels adapted to receive plug-in protectors and the connector assembly is wired to the protector panels; and the connector assembly is adapted to handle up to 200 twisted pairs.

11. A bracket assembly for an enclosure for telecommunications equipment having a base, the bracket assembly adapted to mount first and second connector blocks back-to-back to form a connector assembly adapted to be mounted within the base, wherein:

each of the first and second connector blocks comprises one or more wire connectors on a first side of the connector block and one or more corresponding wire connectors on a second side of the connector block, wherein each wire connector on the first side is electrically connected to a corresponding wire connector on the second side; and after terminating one or more wires at one or more wire connectors of the first connector block on one side of the connector assembly, the connector assembly can be removed from the base, rotated, and remounted within the base without disconnecting any of the one or more wires, to expose one or more wire connectors of the second connector block on another side of the connector assembly in order to terminate one or more additional wires at one or more wire connectors of the second connector block.

12. The invention of claim 11, wherein the bracket assembly comprises a top bracket and a bottom bracket.

13. The invention of claim 11, wherein the bracket assembly has a plurality of key holes that allow the connector assembly to be removed from the base without having to remove screws that hold the connector assembly onto the base.

14. The invention of claim 13, wherein the bracket assembly comprises a top bracket and a bottom bracket.

15. The invention of claim 1, wherein the one or more wire connectors on the first side of each of the first and second connector blocks are insulation displacement splicing connectors and the one or more wire connectors on the second side of each of the first and second connector blocks are wire-wrap contacts, wherein the first and second connector blocks are mounted back-to-back with the second sides of the first and second connector blocks facing one another.

16. The invention of claim 11, wherein the one or more wire connectors on the first side of each of the first and second connector blocks are insulation displacement splicing connectors and the one or more wire connectors on the second side of each of the first and second connector blocks are wire-wrap contacts, wherein the first and second connector blocks are mounted back-to-back with the second sides of the first and second connector blocks facing one another.

* * * * *